US007480995B2

(12) United States Patent
Adami et al.

(10) Patent No.: US 7,480,995 B2
(45) Date of Patent: Jan. 27, 2009

(54) METHODS FOR PRODUCING A CORRUGATING ROLLER FOR MACHINES TO PRODUCE CORRUGATED CARDBOARD

(75) Inventors: Mauro Adami, Lucca (IT); Desiderio Garcia, Pamplona Navarra (ES)

(73) Assignee: Fosber S.p.A., Lucca (IT)

( * ) Notice: Subject to any disclaimer, the term of this patent is extended or adjusted under 35 U.S.C. 154(b) by 0 days.

(21) Appl. No.: 11/769,258

(22) Filed: Jun. 27, 2007

(65) Prior Publication Data

US 2007/0248712 A1 Oct. 25, 2007

Related U.S. Application Data

(62) Division of application No. 10/860,500, filed on Jun. 3, 2004, now abandoned.

(30) Foreign Application Priority Data

Jun. 4, 2003 (IT) ..... FI2003A0159

(51) Int. Cl.
*B21K 1/02* (2006.01)
*B31F 1/07* (2006.01)

(52) U.S. Cl. ..... 29/895; 492/20; 492/46

(58) Field of Classification Search ..... 29/895; 492/20, 46; 493/471, 463, 454, 380, 403
See application file for complete search history.

(56) References Cited

U.S. PATENT DOCUMENTS 5,279,535 A * 1/1994 Hawes et al. ..... 492/46
5,671,549 A * 9/1997 Jimenez ..... 34/125

* cited by examiner

*Primary Examiner*—David P Bryant
*Assistant Examiner*—Sarang Afzali
(74) *Attorney, Agent, or Firm*—McGlew & Tuttle, P.C.

(57) ABSTRACT

The corrugating roller (7; 9) for machines to produce corrugated cardboard, comprises: a hollow cylindrical body (7B; 9B), with an outer (7D; 9D) surface provided with corrugations (7C; 9C); a circuit for a heat-carrying fluid; and a pair of necks (7E, 7F; 9E, 9F), through at least a first (7E; 9E) of which said heat-carrying fluid is supplied. The body (7B) and the necks (7E, 7F) are produced in a single block machined by removal.

21 Claims, 5 Drawing Sheets

N2
63
55
57
59
61
N2
Co
N
1
5
Z
7A
f7
7H
7C
f41
73
41
39
37
77
79
f39
f9
9C
9H
9
9A
13
17
3
31
81
83
15
11
C
B

METHODS FOR PRODUCING A CORRUGATING ROLLER FOR MACHINES TO PRODUCE CORRUGATED CARDBOARD

CROSS REFERENCE TO RELATED APPLICATIONS

This application is a divisional application under 37 CFR 1.53(b) of prior application Ser. No. 10/860,500 filed Jun. 3, 2004, now abandoned.

FIELD OF THE INVENTION

The present invention pertains to a corrugating roller to produce corrugated cardboard.

The invention also relates to a "single facer" machine to produce corrugated cardboard, comprising a pair of corrugating rollers, between which a sheet of corrugated cardboard passes, and a pressure system to couple the sheet of corrugated cardboard with a sheet of smooth cardboard.

BACKGROUND OF THE INVENTION

The corrugated cardboard is composed of a plurality of sheets of cardboard, alternately smooth and corrugated, glued to one another. To produce this type of cardboard, corrugating or "single facer" machines are used, wherein a pair of corrugating rollers, provided with longitudinal grooves that mesh together, form a nip through which a first sheet of cardboard passes, which is corrugated and provided with a glue on the crests of the flutes. The corrugated sheet is then glued to a smooth sheet or "cover". The product thus obtained can be provided with a second smooth sheet, or cover. Differently, several products coming from a corrugating machine can be superimposed and glued to obtain a corrugated cardboard with several layers.

Corrugating machines of this type are described in EP-A-870598, EP-A-601528, U.S. Pat. No. 6,068,701, EP-A-786329, EP-A-1086805, US-A-20010047850, U.S. Pat. No. 5,415,720, EP-A-734849.

Corrugating rollers are relatively complex components. In fact, they have an internal heating circuit through a heat-carrying fluid, typically steam. The heat-carrying fluid circuit has an internal duct and a series of external ducts, in proximity to the cylindrical surface of the roller, to obtain efficient heat exchange.

Due to their complex nature, currently known corrugating rollers are produced with several components. For example, U.S. Pat. No. 4,917,664 describes a corrugating roller constituted by two head ends on which the shanks or necks to support the roller are provided. The head ends are connected to a hollow cylindrical body, on the outer surface of which ribs or grooves are produced to perform corrugation of the cardboard, and in the cylindrical wall of which ducts are produced parallel to the axis of the roller for circulation of the heat-carrying fluid. The ducts are disposed to allow the heat-carrying fluid to flow alternately in one direction and in the opposite direction.

ES-B-2070726 describes a corrugating roller comprising a interchangeable external cylindrical jacket, on which grooves or corrugations are produced, fitted on a grooved and radially perforated central core. Once the jacket has been mounted on the central core, these grooves form longitudinal ducts for circulation of the heat-carrying fluid. The core is axially perforated to define an inlet duct and an outlet duct of the heat-carrying fluid. It forms, with its ends, the end necks or shanks of the roller.

ES-A-2110871 describes a corrugating roller comprising a hollow cylindrical body, at the ends of which two portions forming the shanks or necks of the roller are inserted. One of the two portions has an inlet duct and an outlet duct for the heat-carrying fluid, which circulates in an interspace with an annular section formed by the inner wall of the hollow cylindrical body and by a pipe coaxial to said body.

EP-B-657275 describes a corrugating roller comprising a hollow cylindrical body, in the wall of which circulation ducts for the heat-carrying fluid are produced. The ducts are fed through head ends forming the necks or shanks supporting the roller. The head ends are inserted into the axial cavity of the cylindrical body.

U.S. Pat. No.5,899,264 and EP-A-1962590 describe a corrugating roller constituted by a hollow cylindrical body, in the wall of which ducts for circulation of the heat-carrying fluid are produced. The fluid is fed through an axial hole produced in one head end of the roller, fixed to the central cylindrical body and passes through a duct coaxial to the cylinder, extending through the hollow cylindrical body thereof, to the opposite head end from which the fluid is distributed radially to the peripheral ducts produced in the cylindrical wall of the body of the roller. Radial holes in the first head end collect the spent heat-carrying fluid and convey it outside.

All the constructional solutions described in the aforesaid documents are complex and costly and in some cases somewhat inefficient from a thermal point of view, as they do not allow efficacious heating of the outer surface of the corrugating roller.

SUMMARY OF THE INVENTION

The object of the present invention is the production of a corrugating roller for corrugating machines to produce corrugated cardboard which is simple and inexpensive to produce, maintaining a high level of thermal efficiency, that is high characteristics of heat exchange between the heat-carrying fluid and the roller towards the outer surface thereof.

Essentially, according to the invention, a corrugating roller is provided for machines to produce corrugated cardboard, comprising: a hollow cylindrical body, with an outer surface provided with corrugations; a circuit for a heat-carrying fluid; and a pair of necks, through at least a first of which said heat-carrying fluid is supplied. Characteristically, according to the invention, the body and the necks are produced in a single block machined by removal. This simplifies and reduces the construction costs of the corrugating rollers.

According to a practical embodiment, the corrugating roller comprises an axial cavity extending through a first of said two necks and essentially for the entire axial extension of the cylindrical body of the roller, and a plurality of peripheral longitudinal ducts, parallel to the axis of the roller in proximity to the cylindrical surface of said body, in communication with the axial cavity through a first series of essentially radial ducts and a second series of essentially radial ducts for flow of the heat-carrying fluid from the axial cavity into said peripheral longitudinal ducts and therefrom back into the axial cavity. The axial cavity, the longitudinal ducts and the radial ducts are advantageously obtained by boring.

Further advantageous characteristics and embodiments of the roller according to the invention are indicated in the attached dependent claims.

The invention also relates to a corrugating machine comprising two corrugating rollers, one of which or preferably both of which are produced by a single block of material machined by mechanical removal.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
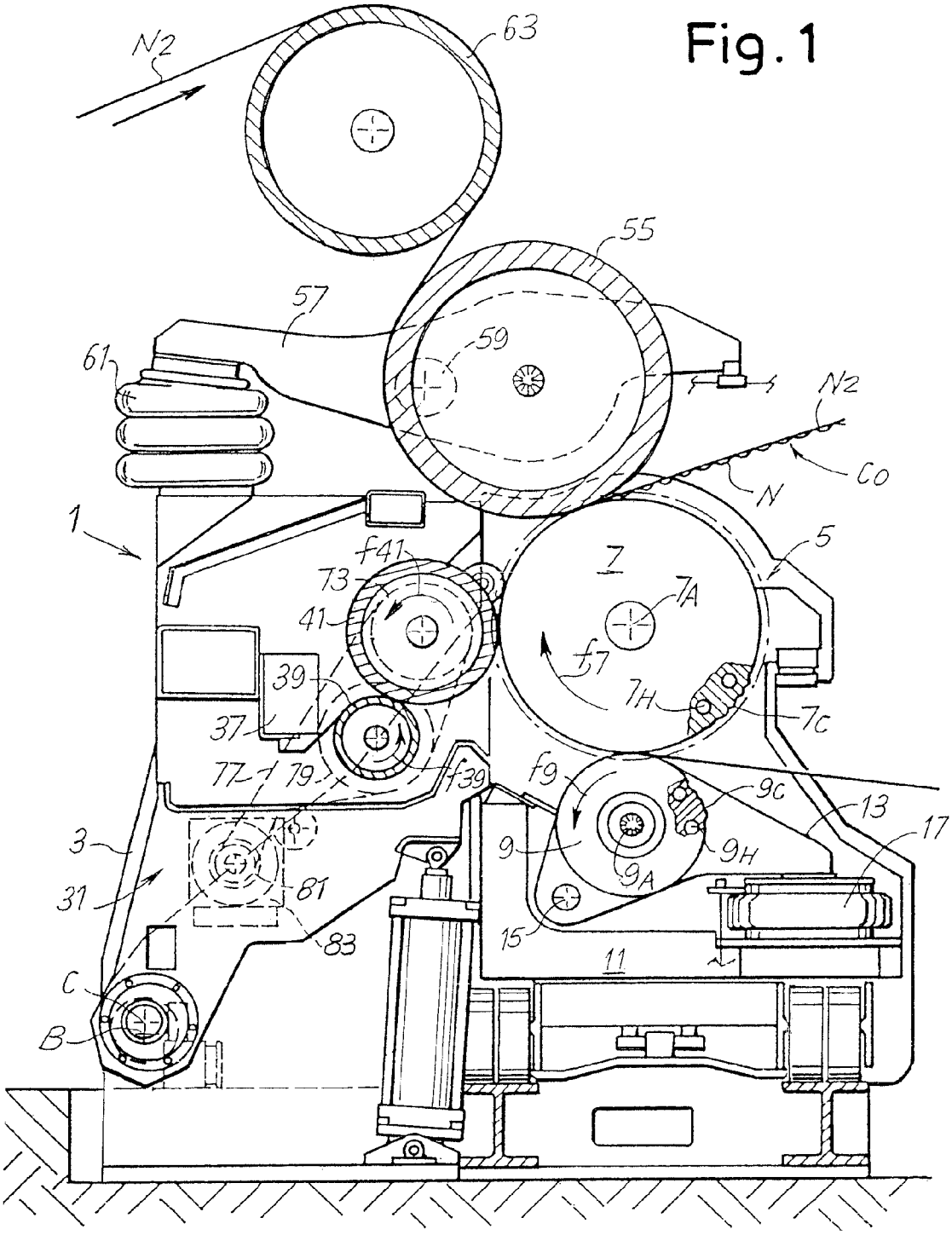
FIG. 1 shows a side view of a corrugating machine.

Referring to the drawings in particular, FIG. 1 shows a corrugating machine or "single facer" in which the invention may be incorporated. The machine, indicated as a whole with 1, has a load-bearing structure 3, inserted into which is a unit 5 comprising a first corrugating roller 7 and a second corrugating roller 9.

On its cylindrical surface the corrugating roller 7 has a plurality of ribs or corrugations 7C, meshing with corresponding corrugations or ribs 9C of the second corrugating roller 9. A web material N, such as a sheet of paper or cardboard, is made to pass through the nip defined between the two rollers 7 and 9, where the ribs 7C and 9C mesh with each other, to be subjected to corrugation between the two rollers 7 and 9 and remains adherent, upon delivery from the nip between said rollers, to the first corrugating roller 7.

The first corrugating roller 7 rotates about an axis 7A according to the arrow f7, the axis 7A being essentially fixed with respect to the unit 11 that supports the rollers 7 and 9. Differently, the second corrugating roller 9 is carried by a pair of arms 13 hinged about an axis of oscillation 15, parallel to the axis 7A of the first corrugating roller 7 and to the axis 9A about which the second corrugating roller 9 rotates according to the arrow f9. The second corrugating roller 9 is stressed against the first corrugating roller 7 by a pair of actuators (in the example shown a pair of "torpress") indicated with 17 and acting on the two end arms 13 supporting the axis 9A of the corrugating roller 9.

A gluing unit, indicated as a whole with 31, is fastened to the structure 3 of the machine. The gluing unit 31 is hinged about an axis of oscillation B parallel to the axes 7A and 9A of the corrugating rollers 7 and 9.

The gluing unit 31 bears a glue tank 37, from which glue is collected by a transfer cylinder 39 rotating according to the arrow f39. The transfer cylinder 39 is tangent to a gluing cylinder 41 rotating according to f41 in the same direction as the transfer cylinder 39 and in contact therewith. In this way glue is transferred from the tank 37 to the cylindrical surface of the gluing cylinder 41 and therefrom to the crests of the web material N driven about the first corrugating roller 7 and previously deformed in the nip between the corrugating roller 7 and the corrugating roller 9.

Along the extension of the corrugating roller 7, downstream of the gluing area defined by the position of the gluing cylinder 41, a pressure roller 55 is provided, supported by a pair of arms 57 hinged in 59 to the fixed structure 3 and stressed by actuators 61 so as to press the pressure roller 55 against the corrugating roller 7. A second continuous web material, for example a sheet of paper material indicated with N2, guided by a cylinder 63, is driven about the pressure roller 55. The web material N2 is applied with pressure by the roller 55 on the crests of the web material N previously provided with glue by means of the gluing cylinder 41. The second web material N2 constitutes the "cover" of the corrugated cardboard produced by the machine. Said cardboard, indicated with CO, is thus constituted by the corrugated web material N glued to the smooth web material N2. In a per se known way, this material is subsequently fed to another machine for a second smooth sheet to be applied to the opposite side and, if necessary, combined with other sheets of corrugated cardboard.

The corrugating rollers 7 and 9 are heated internally by circulation of a heat-carrying fluid, typically steam. Characteristically, according to the present invention, the corrugating rollers are produced in a single piece, that is "monobloc", and the channels for fluid circulation, and the supporting necks are produced by machine removal from a single block.

The configuration of the two rollers 7 and 9 is represented in FIGS. 2 to 5. In particular, the roller 7 (FIG. 3) has a cylindrical body 7B with an essentially cylindrical side surface 7D provided with corrugations 7C. In proximity to the head ends of the roller the cylindrical surface 7D has two essentially smooth bands or annular areas, that is without corrugations.

Two necks 7E, 7F produced in one piece by turning from the same metal block forming the main cylindrical body 7B, are integral with the main cylindrical body 7B.

An axial cavity 7G extends through the neck 7E, also extending along the axis of the cylindrical body 7B until it is in proximity to the neck 7F. Moreover, peripheral longitudinal ducts 7H are produced in the cylindrical body 7B, distributed (see FIG. 5) with their axes on a geometrical cylindrical surface coaxial to the cylindrical surface 7D of the corrugating roller 7. The peripheral longitudinal ducts 7H are produced by means of perforation of the cylindrical body 7B and emerge on the opposed and parallel base surfaces 7I of the roller. The peripheral longitudinal ducts 7H are closed at their ends by caps 7J.

Two series of essentially radial ducts, indicated with 7K and 7L, are produced by means of perforation from the outside in proximity to the head ends of the cylindrical body 7B, at the level of the two smooth bands of the outer surface 7D. Each radial duct intersects a corresponding peripheral longitudinal duct 7H and emerges in the axial cavity 7G. The surface holes produced to create the radial ducts 7K and 7L are closed with caps 7M and 7N.

At the level of the caps 7N elements 7P are inserted in the radial ducts 7L to discharge the steam condensate that forms in the peripheral longitudinal ducts 7H. These elements are visible in particular in the enlargement in FIG. 3A and their function is per se known and therefore does not require a detailed description.

Figure 3:
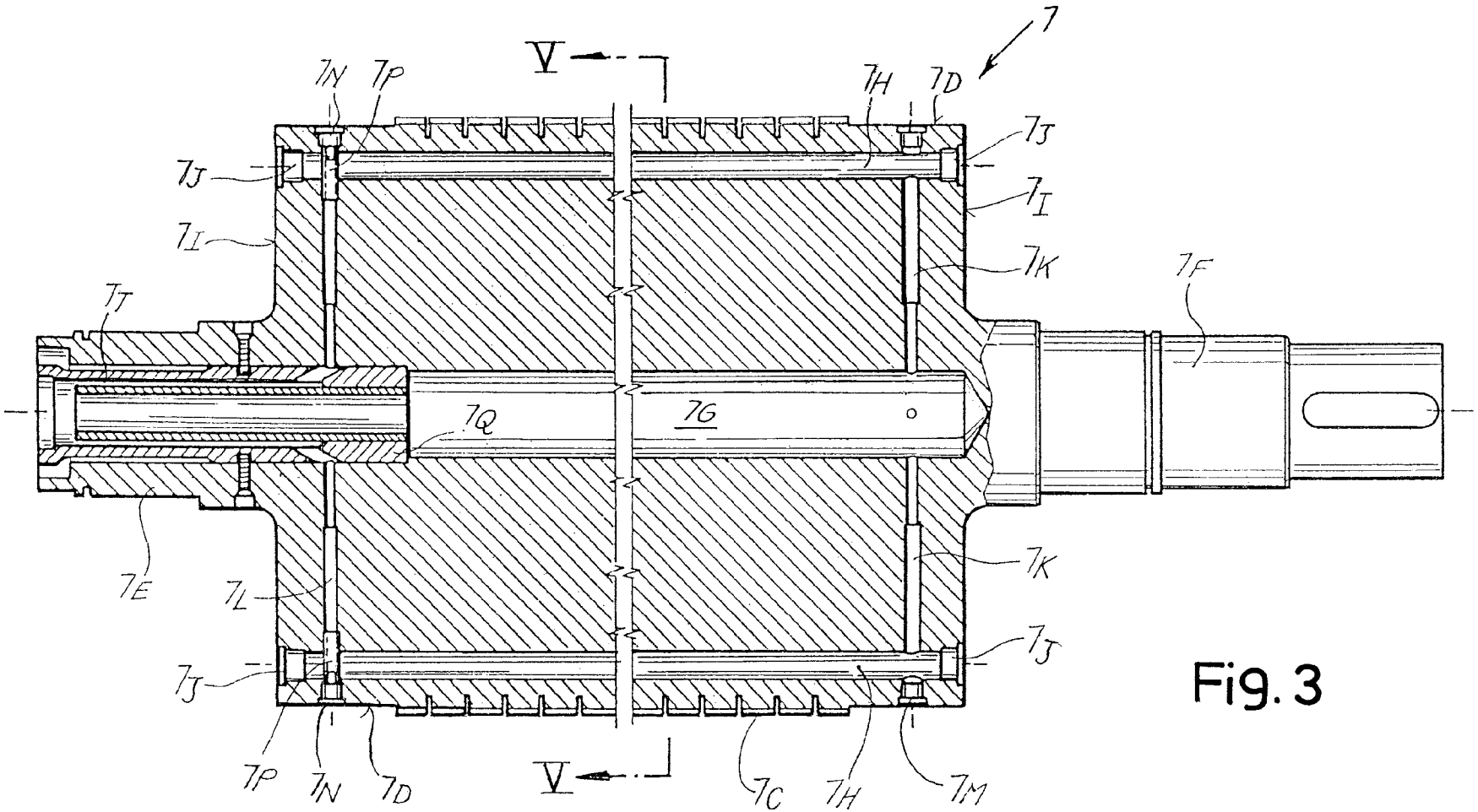
Figure 3A:
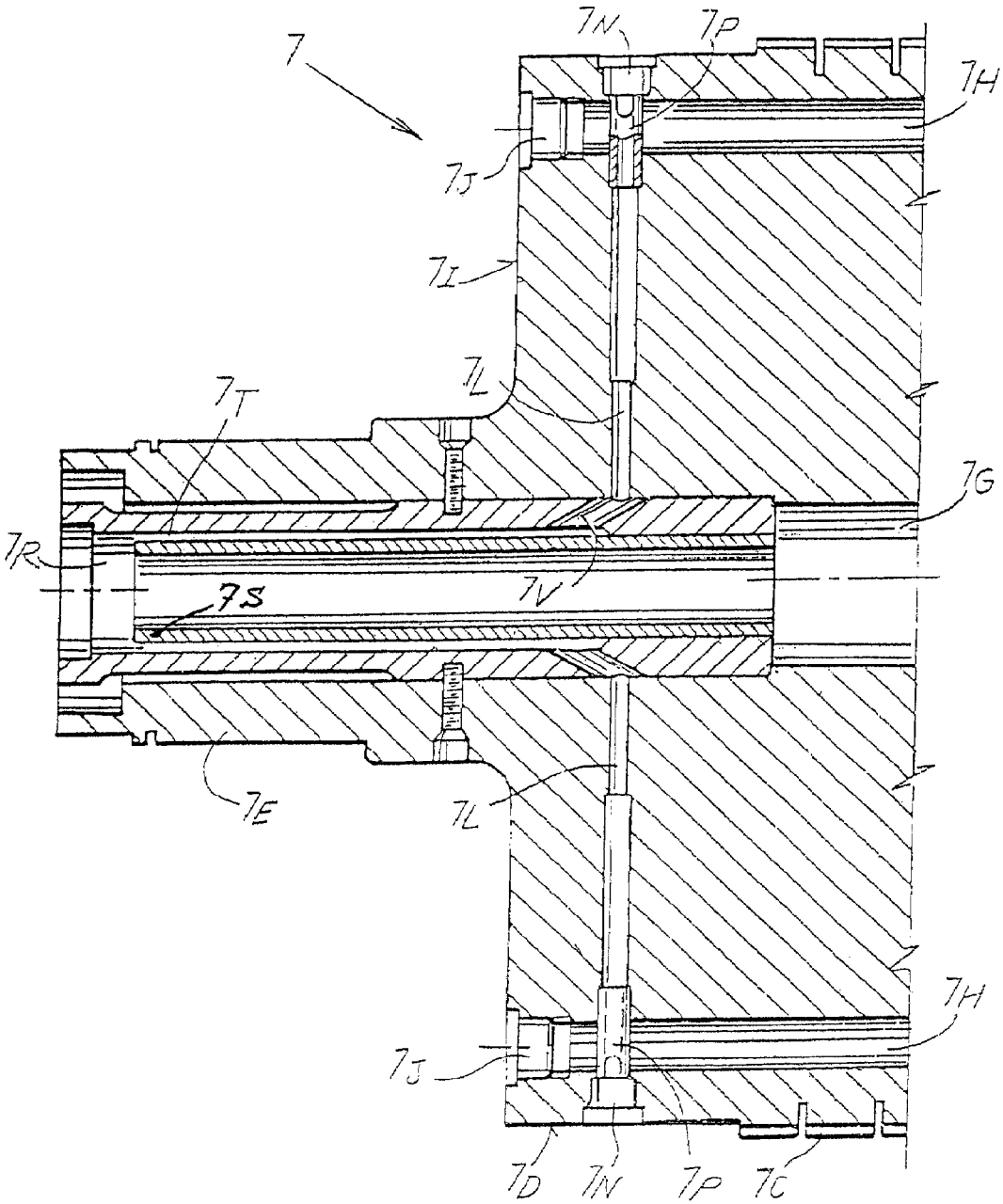
FIG. 3A shows an enlargement of an end portion of a roller.

A distributor element 7Q is inserted into the axial cavity 7G inside the neck 7E, the structure of which is visible in particular in the enlarged detail in FIG. 3A. The distributor element 7Q has an essentially cylindrical extension, with an internal passage 7R coaxial to the cavity 7G, inside which a small tube 7S is inserted. The small tube forms a fluid passage for delivery of the heat-carrying fluid, coming from a rotating manifold, not shown and per se known, towards the inside of the cavity 7G. A fluid passage with an annular section 7T, in which the radial ducts 7L emerge, through inclined holes 7V produced in the cylindrical wall of the distributor element 7Q, is defined between the outer wall of the small tube 7S and the surface of the inner passage 7R of the distributor element 7Q. The spent heat-carrying fluid coming from the radial ducts 7L is collected through the fluid passage with annular section 7T.

Therefore, by means of mechanical machining of a single metal block, a channel is formed in the roller 7 for the heat-carrying fluid which from the distributor element 7Q makes the heat-carrying fluid circulate from the neck 7E into the cavity 7G, through the radial ducts 7K, in the peripheral longitudinal ducts 7H and therefrom through the radial ducts 7L back towards the distributor element 7Q and herefrom to the rotating manifold, not shown. The heat-carrying fluid yields the majority of its heat to the outer cylindrical surface 7D and to the ribs or corrugations 7C of the roller.

As can be seen in the drawing, the axial cavity 7G has a relatively small diameter with respect to the diameter of the cylindrical surface 7D of the roller and the peripheral longitudinal ducts are positioned closer together with respect to said surface 7D. In this way heat distribution is optimized through a heat-carrying fluid that enters the cavity 7G and circulates therefrom into the peripheral longitudinal ducts 7H and by conduction heats the surface 7D and in particular the corrugations or ribs 7C. In particular, the diameter of the axial cavity 7G can be from a fourth to an eighth of the diameter of the cylindrical surface 7D. Differently, the diameter of the geometrical cylindrical surface on which the peripheral longitudinal ducts lie is equal to or greater than more or less two thirds and preferably equal to or greater than three quarters of the diameter of the cylindrical surface 7D, so that the ducts are located in proximity to the outer surface of the roller.

Figure 2:
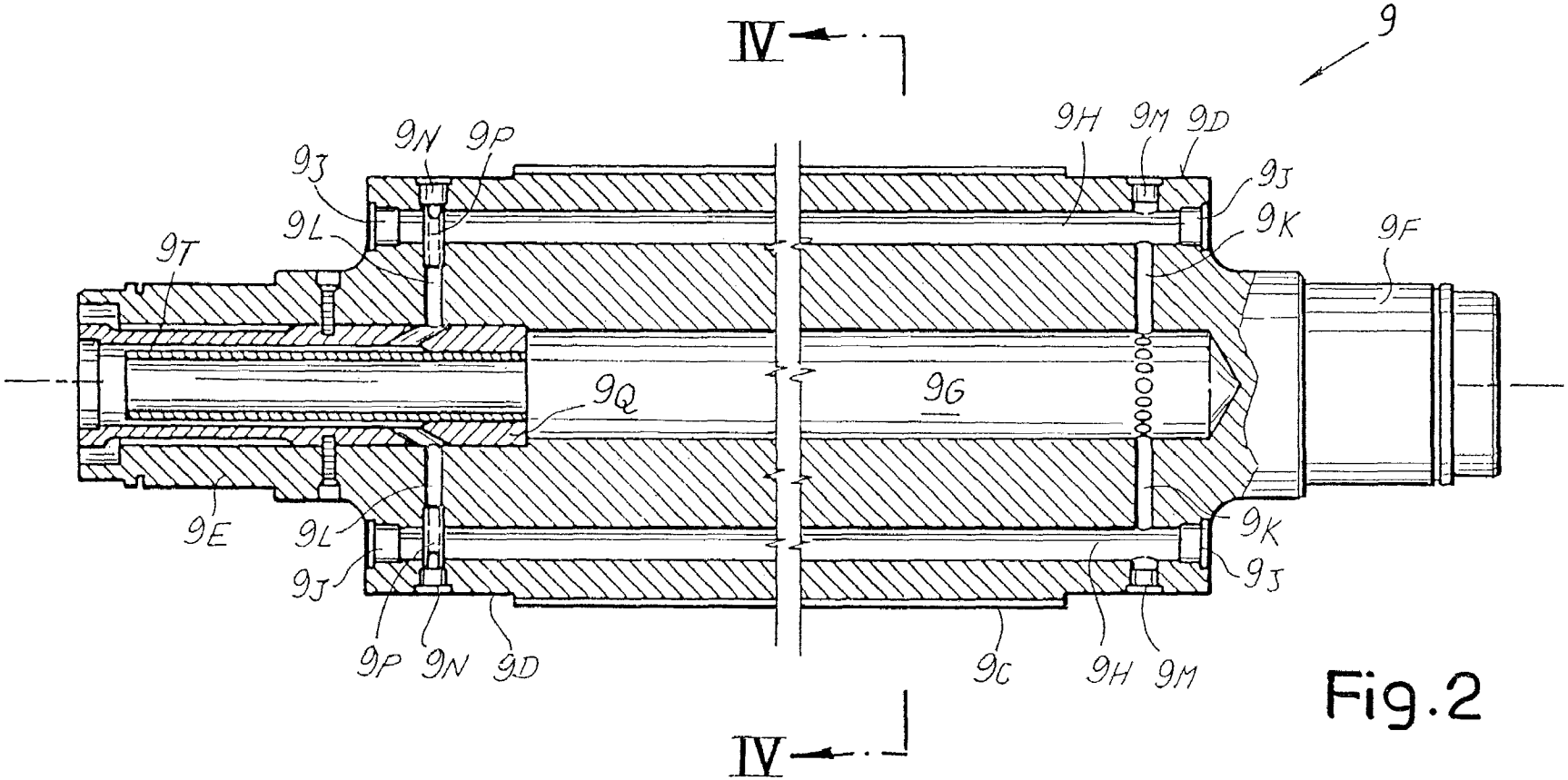
FIGS. 2 and 3 show longitudinal sections of the two corrugating rollers, respectively lower and upper, of the machine in FIG. 1.
Figure 4:
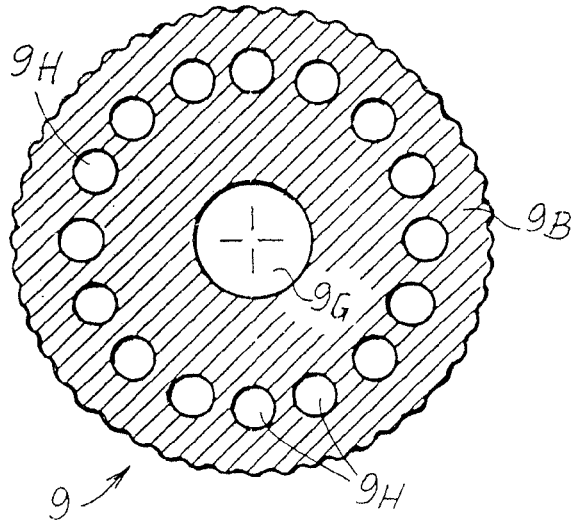
FIGS. 4 and 5 show cross sections according to IV-IV and V-V in FIGS. 2 and 3 respectively.
Figure 5:
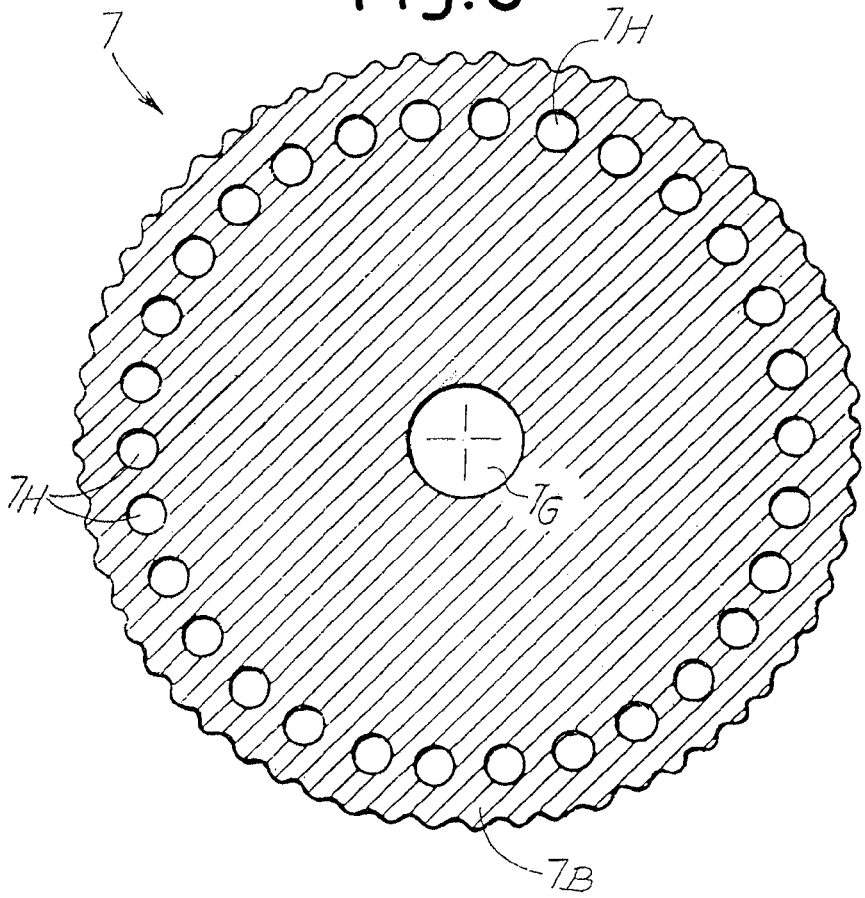

FIGS. 2 and 4 show the structure of the roller 9. This structure is conceptually identical to the structure of the roller 7 with the exception of the different dimensions, as the roller 9 has an essentially smaller diameter. The various parts of the roller 9 shown in FIGS. 2 and 4 are indicated with the number 9 followed by the same letter utilized in FIGS. 3, 3A and 5 for the corresponding parts of the roller 7. It can be seen in the drawing that in this case the diameter of the internal cavity 9G is greater with respect to the diameter of the cylindrical outer surface 9D of the roller, the diameter of the cavity 9G being more or less equal to a quarter of the outer diameter of the cylindrical surface. This is in view of the fact that the cross section of the cavities 7G and 9G must be essentially equal or similar to have the same flow rate of heat-carrying fluid.

The longitudinal axes of the peripheral longitudinal ducts are on an ideal cylindrical surface with a diameter approximately equal to three quarters of the outer diameter of the cylindrical surface 9D and therefore in proximity to said surface to optimizie heat exchange.

In the example shown, the inlet and outlet of the steam for heating the roller are disposed on the same side of the roller. Nonetheless, it must be understood that the inlet and outlet could also be disposed on opposite sides of the roller.

The drawing purely shows a practical embodiment of the invention, which may vary in shapes and layouts without however departing from the scope of protection defined by the claims. Any reference numbers in the claims are provided purely for the purpose of facilitating reading in the light of the description and drawings and do not limit the scope of protection.

While specific embodiments of the invention have been shown and described in detail to illustrate the application of the principles of the invention, it will be understood that the invention may be embodied otherwise without departing from such principles.

What is claimed is:

1. A method for producing a corrugating roller for machines to produce corrugated cardboard, the method comprising:

providing a single block of material;

machining a pair of necks and a central axial cavity from said single block of material;

drilling said single block of material at a first location to form a first longitudinal duct, said first longitudinal duct extending from one end of said single block of material to another end of said single block of material;

drilling said single block of material at a second location of said single block to form a second longitudinal duct, said second longitudinal duct extending from said one end of said single block of material to said another end of said single block of material;

repeating said machining step until said single block of material forms a hollow cylindrical body with an outer surface comprising a plurality of longitudinally extending corrugations, said longitudinal ducts forming a circuit for a heat-carrying fluid, wherein at least one of said pair of necks is supplied with said heat-carrying fluid, said central axial cavity extending within said hollow cylindrical body;

machining said hollow cylindrical body to form a first radial duct located in area of one end of said first longitudinal duct and a second radial duct located in an area of another end of said first longitudinal duct;

machining said hollow cylindrical body to form a third radial duct located in an area of one end of said second longitudinal duct and a fourth radial duct located in an area of another end of said second longitudinal duct; and closing one end of each of said radial ducts at an area adjacent to said corrugations and each end of each of said longitudinal ducts with a closing cap.

2. A method according to claim 1, further comprising the steps of:

machining an axial cavity along an axis of roller, in a first of said pair of necks, said first longitudinal duct and said second longitudinal duct being parallel to said axis of the roller in proximity to said outer surface and ending on front surfaces of said roller, said first radial duct delivering said heat-carrying fluid from said axial cavity into said first longitudinal and therefrom back into said axial cavity via said second radial duct, said third radial duct delivering said heat-carrying fluid from said axial cavity into said second longitudinal duct and therefrom back into said axial cavity via said fourth radial duct, said first radial duct, said second radial duct, said third radial duct and said fourth radial duct extending to said outer surface, said first radial duct and said second radial duct intersecting said first longitudinal duct, said third radial duct and said fourth radial duct intersecting said intersecting said second longitudinal duct.

3. A method according to claim 2, wherein said axial cavity has a diameter equal to or smaller than approximately a quarter of the outer diameter of the roller.

4. A method according to claim 2, wherein the axes of said longitudinal ducts are disposed along a geometrical cylindrical surface, the diameter of which is approximately equal to at least three quarters of the outer diameter of the corrugating roller.

5. A method according to claim 2, wherein said radial ducts are formed by essentially radial holes extending from one side surface of said cylindrical body to said axial cavity, each radial duct being closed radially from the outside by said closing cap.

6. A method according to claim 5, wherein disposed in said first neck, inside said axial cavity is a distributor element with a a tube located therein, said distributor element having an inner surface and a first hole and a second hole, said tube having an outer surface, said outer surface of said tube, said inner surface of said distributor element and said first hole defining a first fluid passage, said first fluid passage being in communication with said second radial duct, said outer surface of said tube, said inner surface of said distributor element and said second hole defining a second fluid passage, said second fluid passage being in communication with said fourth radial duct.

7. A method according to claim 2, wherein said axial cavity extends through an entire extension of said cylindrical body.

8. A method for producing a corrugating roller for machines to produce corrugated cardboard, the method comprising:

providing a single block of material;

machining said single block of material to form a roller with a hollow cylindrical body with an outer surface and a pair of necks and a central axial cavity, said central axial cavity extending within said hollow cylindrical body;

machining said outer surface of said roller such that said outer surface has a plurality of corrugations, each corrugation extending parallel to a longitudinal axis of said roller;

drilling said roller at a first location to form a first longitudinal duct, said first longitudinal duct extending from a first end of said roller to a second end of said roller;

drilling said roller at a second location to form a second longitudinal duct, said second longitudinal duct extending from said first end of said roller to said second end of said roller, said first longitudinal duct not being in communication with said second longitudinal duct;

machining said roller to form a first radial duct located at a first end of said first longitudinal duct and a second radial duct located at a second end of said first longitudinal duct;

machining said roller to form a third radial duct located at a first end of said second longitudinal duct and a fourth radial duct located at a second end of said second longitudinal duct, said first longitudinal duct, said second longitudinal duct, said first radial duct, said second radial duct, said third radial duct and said fourth radial duct forming a circuit for a heat-carrying fluid, wherein at least one of said pair of necks is supplied with said heat-carrying fluid;

providing a plurality of closing caps;

closing one end of each of said radial ducts in area adjacent to said corrugations with one of said closing caps; and closing each of said longitudinal ducts with one of said closing caps.

9. A method according to claim 8, wherein said axial cavity is machined such that said axial cavity extends through at least one of said pair of necks, said first longitudinal duct and said second longitudinal duct being parallel to said longitudinal axis of the roller in an area of said outer surface, said roller having a first surface and a second surface substantially perpendicular to said outer surface, each longitudinal duct extending from said first surface to said second surface, said first radial duct delivering said heat-carrying fluid from said axial cavity into said first longitudinal and therefrom back into said axial cavity via said second radial duct, said third radial duct delivering said heat-carrying fluid from said axial cavity into said second longitudinal duct and therefrom back into said axial cavity via said fourth radial duct, said first radial duct, said second radial duct, said third radial duct and said fourth radial duct extending to said outer surface, said first radial duct and said second radial duct intersecting said first longitudinal duct, said third radial duct and said fourth radial duct intersecting said intersecting said second longitudinal duct.

10. A method according to claim 9, wherein said radial ducts are formed by essentially radial holes extending from one side surface of said cylindrical body to said axial cavity, each radial duct being closed radially from the outside at said outer surface by said closing cap.

11. A method according to claim 10, wherein a distributor element is disposed in one of said first necks, said distributor element being located within said axial cavity, said distributor element having a tube located therein, said distributor element having an inner surface and a first hole and a second hole, said tube having an outer surface, said outer surface of said tube, said inner surface of said distributor element and said first hole defining a first fluid passage, said first fluid passage being in communication with said second radial duct, said outer surface of said tube, said inner surface of said distributor element and said second hole defining a second fluid passage, said second fluid passage being in communication with said fourth radial duct.

12. A method according to claim 9, wherein said axial cavity extends through an entire extension of said cylindrical body.

13. A method according to claim 9, wherein said axial cavity has a diameter equal to or smaller than approximately a quarter of the outer diameter of the roller.

14. A method according to claim 9, wherein the axes of said longitudinal ducts are disposed along a geometrical cylindrical surface, the diameter of which is approximately equal to at least three quarters of the outer diameter of the corrugating roller.

15. A method for producing a corrugating roller for machines to produce corrugated cardboard, the method comprising:

providing a single block of material;

machining said single block of material to form a roller with a hollow cylindrical body with an outer surface and a pair of necks and a central axial cavity, said central axial cavity extending within said hollow cylindrical body;

machining said outer surface of said roller such that said outer surface has a plurality of longitudinally extending corrugations;

drilling said roller at a first location to form a first longitudinal duct, said first longitudinal duct extending from a first end of said roller to a second end of said roller;

drilling said roller at a second location to form a second longitudinal duct, said second longitudinal duct extending from said first end of said roller to said second end of said roller, said first longitudinal duct being parallel to said second longitudinal duct;

machining said roller to form a first radial duct located at a first end of said first longitudinal duct and a second radial duct located at a second end of said first longitudinal duct;

machining said roller to form a third radial duct located at a first end of said second longitudinal duct and a fourth radial duct located at a second end of said second longitudinal duct, said first longitudinal duct, said second longitudinal duct, said first radial duct, said second radial duct, said third radial duct and said fourth radial duct forming a circuit for a heat-carrying fluid, wherein at least one of said pair of necks is supplied with said heat-carrying fluid, said first radial duct being parallel to said second radial duct, said first radial duct and said second radial duct being substantially perpendicular to said first longitudinal duct, said third radial duct being parallel to said fourth radial duct, said third radial duct and said fourth radial duct being substantially perpendicular to said second longitudinal duct;

providing a plurality of closing caps;

closing one end of each of said radial ducts in an area adjacent to said corrugations of said outer surface with one of said closing caps; and closing each of said longitudinal ducts with one of said closing caps.

16. A method according to claim 15, wherein said axial cavity is machined such that said axial cavity extends through at least one of said pair of necks, said first longitudinal duct and said second longitudinal duct being parallel to said longitudinal axis of the roller in an area of said outer surface, said roller having a first surface and a second surface substantially perpendicular to said outer surface, each longitudinal duct extending from said first surface to said second surface, said first radial duct delivering said heat-carrying fluid from said axial cavity into said first longitudinal and therefrom back into said axial cavity via said second radial duct, said third radial duct delivering said heat-carrying fluid from said axial cavity into said second longitudinal duct and therefrom back into said axial cavity via said fourth radial duct, said first radial duct, said second radial duct, said third radial duct and said fourth radial duct extending to said outer surface, said first radial duct and said second radial duct intersecting said first longitudinal duct, said third radial duct and said fourth radial duct intersecting said intersecting said second longitudinal duct.

17. A method according to claim 16, wherein said radial ducts are formed by essentially radial holes extending from one side surface of said cylindrical body to said axial cavity, each radial duct being closed radially from the outside at said outer surface by said closing cap.

18. A method according to claim 17, wherein a distributor element is disposed in one of said first necks, said distributor element being located within said axial cavity, said distributor element having a tube located therein, said distributor element having an inner surface and a first hole and a second hole, said tube having an outer surface, said outer surface of said tube, said inner surface of said distributor element and said first hole defining a first fluid passage, said first fluid passage being in communication with said second radial duct, said outer surface of said tube, said inner surface of said distributor element and said second hole defining a second fluid passage, said second fluid passage being in communication with said fourth radial duct.

19. A method according to claim 16, wherein said axial cavity extends through an entire extension of said cylindrical body.

20. A method according to claim 16, wherein said axial cavity has a diameter equal to or smaller than approximately a quarter of the outer diameter of the roller.

21. A method according to claim 16, wherein the axes of said longitudinal ducts are disposed along a geometrical cylindrical surface, the diameter of which is approximately equal to at least three quarters of the outer diameter of the corrugating roller.

* * * * *